US006261474B1

(12) United States Patent
Egawa et al.

(10) Patent No.: US 6,261,474 B1
(45) Date of Patent: Jul. 17, 2001

(54) LUBRICATING OIL FOR COMPRESSION-TYPE REFRIGERATORS CONTAINING PENTAFLUOROETHANE AND A POLYVINYL ETHER

(75) Inventors: Tatsuya Egawa; Hirotaka Yamasaki; Kenji Mogami; Satoshi Nagao; Toyokazu Handa, all of Sodegaura; Masato Kaneko, Ichihara, all of (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 0 days.

(21) Appl. No.: 08/794,901

(22) Filed: Feb. 4, 1997

(30) Foreign Application Priority Data

Feb. 5, 1996 (JP) ..... 8-018837
Nov. 8, 1996 (JP) ..... 8-296871

(51) Int. Cl.[7] ..... C09K 5/04
(52) U.S. Cl. ..... 252/68; 252/67; 508/579; 508/580
(58) Field of Search ..... 252/68, 67; 508/579, 508/580

(56) References Cited

U.S. PATENT DOCUMENTS

| | | | | |
|---|---|---|---|---|
| 5,431,835 | | 7/1995 | Katafuchi et al. | 252/68 |
| 5,449,472 | * | 9/1995 | Egawa et al. | 252/68 |
| 5,454,963 | * | 10/1995 | Kaneko | 262/68 |
| 5,518,643 | * | 5/1996 | Egawa et al. | 252/68 |
| 5,908,818 | * | 6/1999 | Egawa et al. | 508/579 |

FOREIGN PATENT DOCUMENTS

WO 95/15367 6/1995 (WO) .

OTHER PUBLICATIONS

Chemical Abstracts, AN 124:121047, Watabe et al, "R22 Alternative Refrigerant Refrigerating Unit", Mitsubishi Juko Giho, 1995.*

Chemical Abstracts, AN 125:145943, Ahnefeld et al, "Comparative Energetic Assessment of Selected Fluoro Hydrocarbons as Alternative to R22", DKV–Tagungsber, 1995.*

Chemical Abstracts, AN 125:145954, Doering et al, "Thermodynamic Properties of Closely Boiling Mixtures of R32 and R125", DKV–Tagungsber, 1995.*

* cited by examiner

*Primary Examiner*—Necholus Ogden
(74) *Attorney, Agent, or Firm*—Oblon, Spivak, McClelland, Maier & Neustadt, P.C.

(57) ABSTRACT

A lubricating oil for compression-type refrigerators using a refrigerant containing pentafluoroethane which lubricating oil comprises a polyvinyl ether compound having (a) a constituting unit represented by general formula (I):

(I)

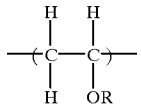

or a polyvinyl ether compound having constituting unit (a) and (b) a constituting unit represented by general formula (I'):

(I')

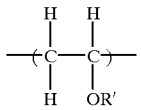

(wherein R represents a hydrocarbon group which has 1 to 3 carbon atoms and may have ether bond in the group, and R' represents a hydrocarbon group which has 3 to 20 carbon atoms and may have ether bond in the group) as the main component. The above lubricating oil shows excellent compatibility with hydrofluorocarbon refrigerants containing pentafluoroethane which can replace chlorofluorocarbons causing environmental pollution, has a high volume intrinsic resistance, and exhibits excellent stability and lubricating property.

12 Claims, No Drawings

LUBRICATING OIL FOR COMPRESSION-TYPE REFRIGERATORS CONTAINING PENTAFLUOROETHANE AND A POLYVINYL ETHER

FIELD OF THE INVENTION

The present invention relates to a lubricating oil for compression-type refrigerators. More particularly, the present invention relates to a lubricating oil for compression-type refrigerators using a hydrofluorocarbon refrigerant containing pentafluoroethane which lubricating oil comprises a polyvinyl ether compound, shows an excellent compatibility with hydrofluorocarbon refrigerants containing pentafluoroethane which can replace chlorofluorocarbons causing environmental pollution, has a volume intrinsic resistance of $10^{12}\Omega$cm or more at 80° C., and exhibits excellent stability and lubricating property.

PRIOR ART OF THE INVENTION

In general, compression-type refrigerators are constituted at least with a compressor, a condenser, an expansion mechanism (such as an expansion valve and a capillary tube), an evaporator, and a drier and has a structure in which a mixed fluid of a refrigerant and a lubricating oil is circulated in the closed system. Temperature is high in the compressor and low in the refrigerating chamber generally in the compression-type refrigerator though the conditions may be different depending on the type of machinery, and it is generally required that the refrigerant and the lubricating oil be circulated in the system without causing phase separation in the wide range of temperature. A mixture of a refrigerant and a lubricating oil generally has regions of phase separation at the low temperature side and at the high temperature side. The highest temperature in the region of phase separation at the low temperature side is preferably −10° C. or lower, more preferably −20° C. or lower. The lowest temperature in the region of phase separation at the high temperature side is preferably 30° C. or higher, more preferably 40° C. or higher. When phase separation occurs during the operation of the refrigerator, life and efficiency of the apparatus are adversely affected to a great extent. For example, when phase separation of the refrigerant and the lubricating oil occurs in the part of the compressor, lubrication of the moving parts is deteriorated, and seizure occurs to cause decrease in the life of the apparatus to a great extent. When the phase separation occurs in the evaporator, efficiency of heat exchange is decreased because of the presence of lubricating oil of high viscosity.

Because the lubricating oil for refrigerators is used for the purpose of lubricating moving parts in refrigerators, the lubricating property is naturally important. Particularly, because the temperature in the compressor is high, the viscosity which can hold the oil film necessary for the lubrication is important. The required viscosity is different depending on the type of the compressor used and working conditions, and it is generally preferred that the viscosity (kinematic viscosity) of the lubricating oil before mixing with a refrigerant is 5 to 200 cSt, more preferably 5 to 100 cSt, at 40° C. When the viscosity is lower than this range, the oil film becomes thin to cause insufficient lubrication. When the viscosity is higher than this range, efficiency of the heat exchange is decreased.

Electric refrigerators and air conditioners have a motor and a compressor integrally built into a single body, and the lubricating oil for them is required to have a high degree of electric insulating property. In general, a volume intrinsic resistance of $10^{12}$ Ωcm or more at 80° C. is required. When the resistance is lower than this value, possibility of leak of electricity arises. Moreover, high stability is required for a lubricating oil. For example, when organic acids are formed by hydrolysis or the like, corrosion and wear of the apparatus tend to take place although degree of the corrosion and the wear depends on the amount of the organic acids.

As the refrigerant for compression-type refrigerators, particularly for air conditioners, mainly chlorodifluoromethane (hereinafter referred to as R22) or a mixture of chlorodifluoromethane and chloropentafluoroethane in a ratio by weight of 48.8 and 51.2 (hereinafter referred to as R502) has heretofore been used. As the lubricating oil, various types of mineral oils and synthetic oils satisfying the required properties described above have been used. However, R22 and R502 are more rigorously restricted world-wide because there is the possibility that they cause environmental pollution such as the ozonosphere destruction. By this reason, hydrofluorocarbons represented by 1,1,1,2-tetrafluoroethane, difluoromethane, pentafluoroethane, and 1,1,1-trifluoroethane (hereinafter referred to as R134a, R32, R125, and R143a, respectively) are attracting attention as the novel types of the refrigerant. The hydrofluorocarbons, particularly R134a, R32, R125, and R143a, are preferred as the refrigerant for compression-type refrigerators because they have little possibility of causing the ozonosphere destruction. However, the above hydrofluorocarbon causes a problem when it is used singly. For example, it is reported in "Energy Shigen (Energy and Resources)" Volume 16, Number 5, Page 474 that (1) when R134a is applied to an air conditioner to replace R22, the pressure in operation is lower, and the ability is decreased by about 40% and the efficiency is decreased by about 5% from those obtained by using R22; (2) R32 shows a higher efficiency but a higher pressure in operation than those obtained by using R22 and is slightly combustible; and (3) R125 has a lower critical pressure to cause decrease in the efficiency although it is not combustible. R143a has the problem of combustibility like R32.

It is desirable that a refrigerant for compression-type refrigerators can be used without change in the structure of the currently used refrigerator. However, the above mixed hydrofluorocarbon refrigerants must be used actually because of the problems described above. More specifically, it is desirable in view of the efficiency that R32 and R143a which are combustible are used to replace R22 and R502 which are currently used, and R125 or R134a is mixed to R32 or R143a to provide the incombustibility. It is described in The International Symposium on R22 & R502 Alternative Refrigerants, 1994, Page 166 that a mixture of R32 and R134a is combustible when the content of R32 is 56% by weight or more. In view of the incombustibility, a refrigerant containing 45% by weight or more of an incombustibile hydrofluorocarbon such as R125 and R134a is desirable although the content may be different depending on the composition of the refrigerant.

On the other hand, a refrigerant is used under various conditions in a refrigeration system, and it is not desirable that the composition of the refrigerant containing hydrofluorocarbons is different to a great extent in various parts of a refrigeration system. The refrigerant is in the gaseous state as well as in the liquid states in one refrigeration system. Therefore, when boiling points of hydrofluorocarbons used as a mixture are different to a great degree, there is the possibility that the composition of the mixed refrigerant is different to a great extent in various parts of the refrigeration system because of the above reason.

Boiling points of R32, R143a, R125, and R134a are −51.7° C., −47.4° C., −48.5° C., and −26.3° C., respectively. Using R134a in a mixed hydrofluorocarbon refrigerant must be made carefully in view of the above consideration. Therefore, when R125 is used in a mixed refrigerant, it is preferred that the content of R125 is 20 to 80% by weight, more preferably 40 to 70% by weight. When the content is less than 20% by weight, a refrigerant having a different boiling point such as R134a must be used in a larger amount in order to provide the obtained mixed refrigerant with the incombustibility, and the content is not preferable by the above reason. When the content of R125 is more than 80% by weight, the efficiency is decreased, and the content is not preferable, either.

From the reasons described above, a mixture of R32, R125, and R134a in a ratio by weight of 23:25:52 (hereinafter referred to as R407C), a mixture of R32 and R125 in a ratio by weight of 50:50 (hereinafter referred to as R410A), and a mixture of R32 and R125 in a ratio by weight of 45:55 (hereinafter referred to as R410B) are preferred as the mixed refrigerant to replace the refrigerant of R22. A mixture of R125, R143a, and R134a in a ratio by weight of 44:52:4 (hereinafter referred to as R404A), and a mixture of R125 and R143a in a ratio by weight of 50:50 (hereinafter referred to as R507) are preferred as the mixed refrigerant to replace the refrigerant of R502.

These mixed refrigerants are advantageous also because these refrigerants show small change in the composition when the refrigerants are placed into the apparatus or leak out of the apparatus.

When R404A, R410A, R410B, or R507 is used to replace R22 or R502 in a compression-type refrigerator in which R22 or R502 has been used as the refrigerant, a lubricant is naturally required to have excellent compatibility with the mixed hydrofluorocarbon refrigerant and the other requirements described above which are a volume intrinsic resistance of $10^{12}$ Ω•cm (80° C.) or more and excellent stability and lubricating property.

However, the lubricating oils which have heretofore been used in combination with R22 or R502 do not have an excellent compatibility with the mixed hydrofluorocarbon refrigerants such as R404A, R410A, R410B, and R507. Therefore, a new lubricating oil suitable for these mixed refrigerants is necessary. When the refrigerants of R22 and R502 are replaced with new refrigerants, it is desired that little change in the structures of apparatus is required. It is not desirable that the structures of the currently used apparatus must be changed to a great extent by replacing a lubricant.

As the lubricant having a good compatibility with these mixed hydrofluorocarbon refrigerants, polyalkylene glycol lubricants, polyol ester lubricants, and carbonate lubricants have been known. The polyalkylene glycol lubricant has a low volume intrinsic resistance, and the polyol ester lubricants and the carbonate lubricants are easily hydrolyzed to cause a problem in the stability. Therefore, development of a lubricant showing compatibility with the above mixed hydrofluorocarbon refrigerants, having a high volume intrinsic resistance, and exhibiting excellent stability and lubricating property has been desired.

Under the above circumstances, the present invention has an object of providing a lubricating oil for compression-type refrigerators which shows excellent compatibility with mixed hydrofluorocarbon refrigerants containing R125, such as R410A, R410B, R404A, and R507, which can replace chlorofluorocarbons causing environmental pollution, has a high volume intrinsic resistance, and exhibits excellent stability and lubricating property.

The present invention has another object of providing an apparatus for refrigeration using the above lubricant and a mixed hydrofluorocarbon refrigerant containing R125, and a compressor for refrigerants which is suitable for forming a refrigeration cycle in the above apparatus for refrigeration.

SUMMARY OF THE INVENTION

As the result of extensive studies conducted by the present inventors to develop the lubricating oil having the above desirable properties, it was discovered that the above objects can be achieved by a lubricating oil comprising a polyvinyl ether compound having specific constituting units as the main component. The present invention has been completed on the basis of the discovery.

Accordingly, the present invention provides a lubricating oil for compression-type refrigerators using a hydrofluorocarbon refrigerant containing pentafluoroethane which lubricating oil comprises a polyvinyl ether compound having (a) a constituting unit represented by the following general formula (I):

(I)

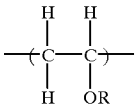

(wherein R represents a hydrocarbon group which has 1 to 3 carbon atoms and may have ether bond in the group) or a polyvinyl ether compound having constituting unit (a) and (b) a constituting unit represented by the following general formula (I'):

(I')

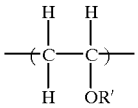

(wherein R' represents a hydrocarbon group which has 3 to 20 carbon atoms, may have ether bond in the group, and is different from the hydrocarbon group represented by R in general formula (I)) as the main component of the lubricating oil.

The present invention relates to an apparatus for refrigeration having a refrigeration cycle constituted at least with a compressor, a condenser, an expansion mechanism, an evaporator, and optionally a drier, and containing the above-described lubricating oil and a hydrofluorocarbon refrigerant containing pentafluoroethane. The present invention also relates to (i) a high pressure compressor for refrigerants which comprises a motor having a rotor and stator and disposed in a closed vessel containing a lubricating oil, a rotary shaft fitted to the rotor, and a compressor part connected to the motor through a rotary shaft and contains a high pressure gas of a refrigerant in the closed vessel; and (ii) a low pressure compressor for refrigerants which comprises a motor having a rotor and stator and disposed in a closed vessel containing a lubricating oil, a rotary shaft fitted to the rotor, and a compressor part connected to the motor through a rotary shaft, and discharges a high pressure gas of a refrigerant directly out of the closed vessel. The above compressors for refrigerants contain the above lubricating oil and a hydrofluorocarbon refrigerant containing pentafluoroethane.

DETAILED DESCRIPTION OF THE INVENTION

The lubricating oil for compression-type refrigerators of the present invention comprises the polyvinyl ether compound having constituting unit (a) represented by general formula (I) or the polyvinyl ether compound having constituting unit (a) represented by general formula (I) and constituting unit (b) represented by general formula (I') as the main component of the lubricating oil.

R in general formula (I) represents a hydrocarbon group which has 1 to 3 carbon atoms and may have ether bond in the group. Specific examples of the hydrocarbon group represented by R include methyl group, ethyl group, n-propyl group, isopropyl group, and 2-methoxyethyl group. R' in general formula (I') represents a hydrocarbon group which has 3 to 20 carbon atoms and may have ether bond in the group. Specific examples of the hydrocarbon group represented by R' include alkyl groups, such as n-propyl group, isopropyl group, n-butyl group, isobutyl group, sec-butyl group, tert-butyl group, various types of pentyl group, various types of hexyl group, various types of heptyl group, and various types of octyl group; cycloalkyl groups, such as cyclopentyl group, cyclohexyl group, various types of methylcyclohexyl group, various types of ethylcyclohexyl group, and various types of dimethylcyclohexyl group; aryl groups, such as phenyl group, various types of methylphenyl group, various types of ethylphenyl group, and various types of dimethylphenyl group; arylalkyl groups, such as benzyl group, various types of phenylethyl group, and various types of methylbenzyl group; and alkyl groups having ether bond in the group, such as 2-methoxyethyl group, 2-ethoxyethyl group, 2-methoxy-1-methylethyl group, 2-methoxy-2-methylethyl group, 3,6-dioxaheptyl group, 3,6,9-trioxadecyl group, 1,4- dimethyl-3,6-dioxaheptyl group, 1,4,7-trimethyl-3,6,9-trioxadecyl group, 2,6-dioxa-4-heptyl group, and 2,6,9-trioxa-4-decyl group.

The vinyl ether compounds may have a single type or two or more types of constituting units (a) and (b). When the vinyl ether compounds have both constituting units (a) and (b), R in general formula (I) representing constituting unit (a) and R' in general formula (I') representing constituting unit (b) are not the same.

In general formula (I) representing constituting unit (a), R preferably represents methyl group or ethyl group, more preferably ethyl group (constituting unit (a') which is shown in the examples). In general formula (I') representing constituting unit (b), R' preferably represents a hydrocarbon having 3 to 6 carbon atoms, more preferably isobutyl group (constituting unit (b') which is shown in the examples).

The ratio by mol of constituting unit (a) and constituting unit (b) is preferably in the range of 10:0 to 5:5, more preferably in the range of 10:0 to 7:3, most preferably in the range of 10:0 to 8:2.

In the present invention, the kinematic viscosity of the vinyl ether compound is preferably in the range of 5 to 200 cSt, more preferably in the range of 5 to 100 cSt, at 40° C. Therefore, the degree of polymerization can be selected suitably so that the kinematic viscosity is in the above range.

The polyvinyl ether compound used in the lubricating oil of the present invention can be prepared by polymerizing the corresponding vinyl ether monomer. More specifically, the polyvinyl ether compound having constituting unit (a) can be obtained by polymerizing one or more types of a vinyl ether monomer represented by the following general formula (V):

(V)

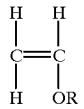

(wherein R is as defined above). The polyvinyl ether compound having constituting units (a) and (b) can be obtained by copolymerizing one or more types of the vinyl ether monomer represented by general formula (V) and one or more types of a vinyl ether monomer represented by the following general formula (V'):

(V')

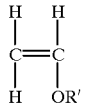

(wherein R' is as defined above).

Examples of the vinyl ether monomer represented by general formula (V) include vinyl methyl ether, vinyl ethyl ether, vinyl n-propyl ether, vinyl isopropyl ether, and vinyl 2-methoxyethyl ether. Examples of the vinyl ether monomer represented by general formula (V') include vinyl n-propyl ether, vinyl isopropyl ether, vinyl n-butyl ether, vinyl isobutyl ether, vinyl sec-butyl ether, vinyl tert-butyl ether, vinyl n-pentyl ether, vinyl n-hexyl ether, vinyl 2-methoxyethyl ether, vinyl 2-ethoxyethyl ether, vinyl 2-methoxy-1-methylethyl ether, vinyl 2-methoxy-2- methylethyl ether, vinyl 3,6-dioxaheptyl ether, vinyl 3,6,9-trioxadecyl ether, vinyl 1,4-dimethyl-3,6-dioxaheptyl ether, vinyl 1,4,7-trimethyl- 3,6,9-trioxadecyl ether, vinyl 2,6-dioxa-4-heptyl ether, and vinyl 2,6,9- trioxa-4-decyl ether. These vinyl ether monomers can be prepared by conventional methods.

As the polyvinyl ether compound used in the lubricating oil of the present invention, a polyvinyl ether compound in which one end has a structure represented by the following general formula (II):

(II)

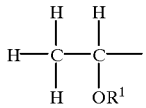

(wherein $R^1$ represents a hydrocarbon group which has 1 to 20 carbon atoms and may have ether bond in the group), and the other end has a structure represented by the following general formula (III):

(III)

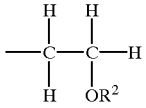

(wherein $R^2$ represents a hydrocarbon group which has 1 to 20 carbon atoms and may have an ether group in the group), and a polyvinyl ether compound in which one end has a structure represented by general formula (II) and the other end has a structure having the following general formula (IV):

(IV)

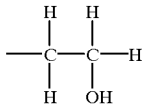

are preferable.

Examples of $R^1$ and $R^2$ in general formulae (III) and (IV) include the groups described above as examples of the groups represented by R and R' in above general formulae (I) and (I').

The lubricating oil for refrigerators of the present invention comprises the above polyvinyl ether compound as the main component. The kinematic viscosity of the lubricating oil before the oil is mixed with a refrigerant is preferably 5 to 200 cSt, more preferably 5 to 100 cSt, at 40° C. The average-molecular weight of the polyvinyl ether compound is generally 150 to 2,000. When a polyvinyl ether compound has a kinematic viscosity outside the above range, the kinematic viscosity of the polyvinyl ether compound can be adjust to a value within the above range by mixing with a polymer having a different kinematic viscosity.

In the lubricating oil for refrigerators of the present invention, a single type or a combination of two or more types of the above polyvinyl ether compound can be used. The above polyvinyl ether compound can be used as a mixture with other lubricants.

To the lubricating oil for refrigerators of the present invention, various types of other additives conventionally used in lubricating oils, such as load carrying additives, chlorine capturing agents, antioxidants, metal deactivators, defoaming agents, detergent-dispersants, viscosity-index improvers, oiliness agents, anti-wear additives, extreme pressure agents, antirust agents, corrosion inhibitors, pour point depressants, and the like, may be added, where necessary.

Examples of the load carrying additive described above include: organic sulfur compound additives, such as monosulfides, polysulfides, sulfoxides, sulfones, thiosulfinates, sulfurized oils and fats, thiocarbonates, thiophenes, thiazoles, and methanesulfonic acid esters; phosphoric ester additives, such as phosphoric monoesters, phosphoric diesters, and phosphoric triesters (such as tricresyl phosphate); phosphorous ester additives, such as phosphorous monoesters, phosphorous diesters, and phosphorous triesters; thiophosphoric ester additives, such as thiophosphoric triesters; fatty acid ester additives, such as higher fatty acids, hydroxyaryl fatty acids, esters of polyhydric alcohols, and acrylic esters; organic chlorine additives, such as chlorinated hydrocarbons and chlorinated carboxylic acid derivatives; organic fluorine additives, such as fluorinated aliphatic carboxylic acids, fluoroethylene resins, fluoroalkyl polysiloxanes, and fluorinated graphite,; alcohol additives, such as higher alcohols; and additives of metallic compounds, such as salts of naphthenic acid (such as lead naphthenate), salts of fatty acids (such as lead salts of fatty acids), salts of thiophosphates (such as zinc dialkyldithiophosphates), salts of thiocarbamic acid, organomolybdenum compounds, organotin compounds, organogermanium compounds, and boric acid esters.

Examples of the chlorine capturing agent include compounds having glycidyl ether group, epoxidized fatty acid monoesters, epoxidized fats and oils, and compounds having epoxycycloalkyl group. Examples of the antioxidant include phenols (such as 2,6-di-tert-butyl-p-cresol) and aromatic amines (such as α-naphthylamine). Examples of the metal deactivator include benzotriazole derivatives. Examples of the defoaming agent include silicone oils (such as dimethylpolysiloxane) and polymethacrylates. Examples of the detergent dispersants include sulfonates, phenates, and succinimides. Examples of the viscosity index improver include polymethacrylates, polyisobutylene, ethylene-propylene copolymers, and hydrogenated styrene-diene copolymers.

The lubricating oil of the present invention is used for compression-type refrigerators which uses a hydrofluorocarbon refrigerant containing R125. The hydrofluorocarbon refrigerant preferably contains 20 to 80% by weight, more preferably 40 to 70% by weight, of R125. When a hydrofluorocarbon refrigerant contains 40 to 70% by weight of R125, it is not necessary that a refrigerant having a boiling point different to a great degree, such as R134a, is mixed in a large amount in order to provide the refrigerant with incombustibility, and the hydrofluorocarbon refrigerant shows a high efficiency. The hydrofluorocarbon shows little change in the composition when the refrigerants are placed into the apparatus or leak out of the apparatus. Preferable examples of the hydrofluorocarbon refrigerant include R410A, R410B, R404A, and R507.

The refrigerating apparatus used in the present invention has a refrigerating cycle comprising a compressor, a condenser, an expansion mechanism (such as an expansion valve and a capillary tube), and an evaporator as the essential components, or a refrigerating cycle comprising a compressor, a condenser, an expansion mechanism, a drier, and an evaporator as the essential components. The refrigerating apparatus uses the lubricating oil of the present invention as the lubricating oil (the refrigerator oil) and a hydrofluorocarbon refrigerant containing pentafluoroethane as the refrigerant.

It is preferred that the drier is packed with a drying agent which is made of zeolite having a pore diameter of 3.3 Å or less. Examples of the zeolite include natural zeolites and synthetic zeolites. Zeolite having a volume of absorption of $CO_2$ gas of 1.0% or less at 25° C. under a partial pressure of $CO_2$ gas of 250 mmHg is more preferable. Examples of the more preferable zeolite include commercial products having trade names of XH-9 and XH-600 which are products of UNION SHOWA Co., Ltd. When zeolite has a large volume of absorption of $CO_2$ gas, the amount of absorption of fluorine ion is increased. This leads to decrease in the adsorption property and the strength at break which are required as the molecular sieve, and various troubles are caused.

When the above drying agent is used, water can efficiently be removed while the refrigerant in the refrigeration cycle is not absorbed. Moreover, pulverization of the drying agent by degradation of the drying agent itself can be suppressed, and the possibility of choking pipings with the formed powder and abnormal wear by invasion of the powder into sliding parts of the compressor can be eliminated. Thus, the refrigeration apparatus can be operated for a long time with stability.

The compressor for refrigerants is a component constituting the refrigeration cycle of the above refrigerating apparatus. The compressor used in the present invention include the high pressure compressor and the low pressure compressor both described above. In both types, it is preferred that the winding in the stator of a motor has a core (such as a magnet wire) coated with an enamel having a glass transition temperature of 120° C. or higher or with a varnish having a glass transition temperature of 50° C. or higher. As the enamel coating, a single layer or a composite layer of a polyester imide, a polyamide, or a polyamide imide is preferable. The enamel coating prepared by laminating a layer having a lower glass transition temperature as the lower layer and a layer having a higher glass transition temperature as the upper layer is excellent in water resistance, resistance to softening, and resistance to swelling, shows high mechanical strength, stiffness, and electric insulation, and is valuable for practical use.

In the compressor for refrigerants, it is preferred that the insulation film used as the electric insulation material in the motor part is made of a crystalline plastics film having a glass transition temperature of 50° C. or higher. It is particularly preferred that the crystalline plastics film contains 5% by weight or less of oligomers.

Preferable examples of the crystalline plastics having a glass transition temperature of 50° C. or higher include polyethylene terephthalate, polybutylene terephthalate, polyphenylene sulfide, polyether ether ketone, polyethylene naphthalate, polyamide imide, and polyimide.

The above insulation film used in the motor part may be a film made of a single layer of the above crystalline plastics or a composite film in which a film having a higher glass transition temperature is laminated on a film having a lower glass transition temperature.

In the compressor for refrigerants, a rubber material for vibration isolation can be disposed at the inside of the compressor. As the rubber material for vibration isolation, a material selected from acrylonitrile- butadiene rubber (NBR), ethylene-propylene-diene rubber (EPDM, EPM), hydrogenated acrylonitrile-butadiene rubber (HNBR), silicone rubbers, and fluororubbers (FKM) can advantageously be used. A rubber showing a degree of swelling of 10% by weight or less is preferable.

In the compressor for refrigerants, various organic materials (such as cover materials of lead wires and binding fibers) can be disposed inside the compressor. As the organic material, a material showing a decrease in the tensile strength of 20% or less is advantageously used.

In the compressor for refrigerants, various sliding parts (such as bearings) are contained. It is preferred that the sliding parts have a roughness of 20 $\mu$m or less, that a steel material constituting the sliding parts has a hardness (Rc) of 30 or more, and that an aluminum material constituting the sliding parts has a hardness (HB) of 90 or more. As the aluminum material, a high silicon aluminum material containing 5% or more of silicon is advantageously used.

In the compressor for refrigerants, it is preferred that the clearance in the sliding parts in the compressor is 30 $\mu$m or less and that a gasket in the compressor has a degree of swelling of 20% or less.

To summarize the advantages of the present invention, the lubricating oil for compression-type refrigerators of the present invention shows excellent compatibility with hydrofluorocarbon refrigerants, such as R404A, R410A, R410B, and R507, which can replace chlorofluorocarbon refrigerants, such as R22 and R502, causing environmental pollution, has a volume intrinsic resistance of $10^{12}$ Ω•cm or more at 80° C., exhibits excellent stability and lubricating property, and can advantageously be used as a lubricating oil for compression-type refrigerators using mixed hydrofluorocarbon refrigerants containing R125.

The present invention is described in more detail with reference to examples in the following. However, the present invention is not limited by the examples.

Preparation Example of Catalyst 1

Into a 2 liter autoclave made of SUS 316L, 12 g of nickel diatomaceous earth catalyst (a product of NIKKI KAGAKU Co., Ltd., trade name, N113) and 300 g of isooctane were placed. The charged autoclave was purged with nitrogen and then with hydrogen. After the pressure of hydrogen was increased to 30 Kg/cm$^2$G, the temperature was increased to 140° C. and kept at 140° C. for 30 minutes, and then the autoclave was cooled to room temperature. The cooled autoclave was purged with nitrogen, and 20 g of acetaldehyde diethylacetal was added to the autoclave. Then, the autoclave was purged with nitrogen again and then with hydrogen. After the pressure of hydrogen was increased to 30 kg/cm$^2$G, the temperature was increased to 130° C. and kept at 130° C. for 30 minutes, and then the autoclave was cooled to room temperature. The pressure inside the autoclave was increased by the increase in the temperature, and at the same time, decrease in the pressure of hydrogen was observed because of the reaction of acetoaldehyde diethylacetal. When the pressure of hydrogen was decreased to a pressure less than 30 kg/cm$^2$G, hydrogen was added, and the pressure was kept at 30 kg/cm$^2$G. After the autoclave was cooled to room temperature, the pressure was released. Then, the autoclave was purged with nitrogen, and the pressure was decreased to atmospheric pressure.

Preparation Example 1

Into a 1 liter glass separable flask, 148,2 g of toluene, 30.18 g ($6.55\times10^{-1}$ mol) of ethanol, and 0.258 g of boron trifluoride etherate were charged. Then, 539.82 g (7.486 mol) of ethyl vinyl ether was added to the obtained mixture during 5 hours. Because heat is generated by the reaction, the flask was cooled in an ice water bath, and the temperature of the reaction solution was kept at 25° C.

The obtained reaction solution was transferred to a 2 liter washing tank and washed with 200 ml of a 3% by weight aqueous solution of sodium hydroxide twice and then with 200 ml of distilled water three times. The solvent and light fractions were removed from the washed reaction solution under a vacuum by using a rotary evaporator to obtain 550.6 g of a crude product.

The autoclave containing the catalyst prepared in Preparation Example of Catalyst 1 was opened. After the liquid part in the autoclave was removed by decantation, 400 g of the crude product obtained above was added to the autoclave. After the autoclave was purged with nitrogen and then with hydrogen, the pressure of hydrogen was increased to 30 kg/cm$^2$G, and the temperature of the autoclave was increased. The temperature was kept at 140° C. for 2 hours, and then the autoclave was cooled to room temperature. The pressure in the autoclave was increased by the increase in the temperature, and decrease in the pressure of hydrogen was also observed because the reaction took place. When the pressure of hydrogen was decreased, hydrogen was suitably added, and the pressure was kept at 30 kg/cm$^2$G.

After the autoclave was purged with nitrogen, the pressure was decreased to atmospheric pressure. The reaction solution was recovered, and 100 g of isooctane was added to the recovered reaction solution. The catalyst was removed from the resultant reaction solution by filtration. The obtained filtrate was treated with a rotary evaporator to remove the solvent and light fractions. The yield was 361 g.

The results of the analysis of the nuclear magnetic resonance spectrum (hereinafter referred to as the NMR analysis) and the analysis of the infrared spectrum (hereinafter referred to as the IR analysis) showed that one of the end structures of the obtained polymer was (A), and the other end structure was mainly (B) and contained 5% by weight or less of structure (C).

(A)

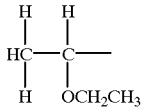

(B)

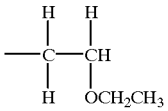

(C)

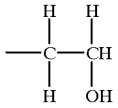

Preparation Example 2

Into a 1 liter glass separable flask, 148,2 g of toluene, 27.38 g ($5.94\times10^{-1}$ mol) of ethanol, 4.90 g ($6.6\times10^{-2}$ mol) of isobutanol, and 0.260 g of boron trifluoride etherate were charged. Then, a mixture of 465.83 g (6.460 mol) of ethyl vinyl ether and 71.89 g ($7.18\times10^{-1}$ mol) of isobutyl vinyl ether was added to the obtained mixture during 5 hours. Because heat is generated by the reaction, the flask was cooled in an ice water bath, and the temperature of the reaction solution was kept at 25° C.

The obtained reaction solution was transferred to a 2 liter washing tank and washed with 200 ml of a 3% by weight aqueous solution of sodium hydroxide twice and then with 200 ml of distilled water three times. The solvent and light fractions were removed from the washed reaction solution under a vacuum by using a rotary evaporator to obtain 550.0 g of a crude product.

An autoclave containing a catalyst prepared in accordance with the same procedures as those conducted in Preparation Example of Catalyst 1 was opened. After the liquid part in the autoclave was removed by decantation, 400 g of the crude product obtained above was added to the autoclave. After the autoclave was purged with nitrogen and then with hydrogen, the pressure of hydrogen was increased to 30 $kg/cm^2G$, and the temperature of the autoclave was increased. The temperature was kept at 140° C. for 2 hours, and then the autoclave was cooled to room temperature. The pressure in the autoclave was increased by the increase in the temperature, and decrease in the pressure of hydrogen was also observed because the reaction took place. When the pressure of hydrogen was decreased, hydrogen was suitably added, and the pressure in the autoclave was kept at 30 $kg/cm^2G$.

After the autoclave was purged with nitrogen, the pressure was decreased to atmospheric pressure. The reaction solution was recovered, and 100 g of isooctane was added to the recovered reaction solution. The catalyst was removed from the resultant reaction solution by filtration. The obtained filtrate was treated by a rotary evaporator to remove the solvent and light fractions. The yield was 362 g.

The results of the NMR analysis and the IR analysis showed that one of the end structures of the obtained polymer was (A) or (D), and the other end structure was mainly (B) or (E) and contained 5% by weight or less of structure (C).

(D)

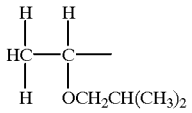

(E)

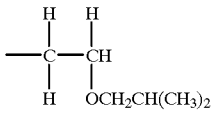

Preparation Example 3

Into a 1 liter glass separable flask, 125 g of isooctane, 60.93 g ($8.22\times10^{-1}$ mol) of isobutanol, and 0.323 g of boron trifluoride etherate were charged. Then, a mixture of 307.06 g (4.258 mol) of ethyl vinyl ether and 202.01 g (2.02 mol) of isobutyl vinyl ether was added to the obtained mixture during 5 hours. Because heat is generated by the reaction, the flask was cooled in an ice water bath, and the temperature of the reaction solution was kept at 45° C.

The obtained reaction solution was transferred to a 2 liter washing tank and washed with 200 ml of a 3% by weight aqueous solution of sodium hydroxide twice and then with 200 ml of distilled water three times. The solvent and light fractions were removed from the washed reaction solution under a vacuum by using a rotary evaporator to obtain 530.0 g of a crude product.

An autoclave containing a catalyst prepared in accordance with the same procedures as those conducted in Preparation Example of Catalyst 1 was opened. After the liquid part in the autoclave was removed by decantation, 400 g of the crude product obtained above was added to the autoclave. After the autoclave was purged with nitrogen and then with hydrogen, the pressure of hydrogen was increased to 30 $kg/cm^2G$, and the temperature of the autoclave was increased. The temperature was kept at 140° C. for 2 hours, and then the autoclave was cooled to room temperature. The pressure in the autoclave was increased by the increase in the temperature, and decrease in the pressure of hydrogen was also observed because the reaction took place. When the pressure of hydrogen was decreased, hydrogen was suitably added, and the pressure in the autoclave was kept at 30 $kg/cm^2G$.

After the autoclave was purged with nitrogen, the pressure was decreased to atmospheric pressure. The reaction solution was recovered, and 100 g of isooctane was added to the recovered reaction solution. The catalyst was removed from the resultant reaction solution by filtration. The obtained filtrate was treated by a rotary evaporator to remove the solvent and light fractions. The yield was 359 g.

The results of the NMR analysis and the IR analysis showed that one of the end structures of the obtained polymer was (A) or (D), and the other end structure was mainly (B) or (E) and contained 5% by weight or less of structure (C).

Preparation Example 4

Into a 1 liter glass separable flask, 125 g of isooctane, 44.70 g ($6.03\times10^{-1}$ mol) of isobutanol, and 0.237 g of boron trifluoride etherate were placed. Then, a mixture of 507.38 g (7.036 mol) of ethyl vinyl ether and 17.96 g ($1.79\times10^{-1}$ mol) of isobutyl vinyl ether was added to the obtained mixture during 5 hours. Because heat is generated by the reaction, the flask was cooled in an ice water bath, and the temperature of the reaction solution was kept at 45° C.

The obtained reaction solution was transferred to a 2 liter washing tank and washed with 200 ml of a 3% by weight aqueous solution of sodium hydroxide twice and then with 200 ml of distilled water three times. The solvent and light fractions were removed from the washed reaction solution under a vacuum by using a rotary evaporator to obtain 543.2 g of a crude product.

An autoclave containing a catalyst prepared in accordance with the same procedures as those conducted in Preparation Example of Catalyst 1 was opened. After the liquid part in the autoclave was removed by decantation, 400 g of the crude product obtained above was added to the autoclave. After the autoclave was purged with nitrogen and then with hydrogen, the pressure of hydrogen was increased to 30 $kg/cm^2G$, and the temperature of the autoclave was increased. The temperature was kept at 140° C. for 2 hours, and then the autoclave was cooled to room temperature. The pressure in the autoclave was increased by the increase in the temperature, and decrease in the pressure of hydrogen was also observed because the reaction took place. When the pressure of hydrogen was decreased, hydrogen was suitably added, and the pressure in the autoclave was kept at 30 $kg/cm^2G$.

After the autoclave was purged with nitrogen, the pressure was decreased to atmospheric pressure. The reaction solution was recovered, and 100 g of isooctane was added to the recovered reaction solution. The catalyst was removed from the resultant reaction solution by filtration. The obtained filtrate was treated by a rotary evaporator to remove the solvent and light fractions. The yield was 360 g.

The results of the NMR analysis and the IR analysis showed that one of the end structures of the obtained polymer was (A) or (D), and the other end structure was mainly (B) or (E) and contained 5% by weight or less of structure (C).

Preparation Example 5

Into a 1 liter glass separable flask, 125 g of isooctane, 62.56 g ($8.44\times10^{-1}$ mol) of isobutanol, and 0.332 g of boron trifluoride etherate were charged. Then, a mixture of 247.8 g (3.436 mol) of ethyl vinyl ether and 259.65 g (2.592 mol) of isobutyl vinyl ether was added to the obtained mixture during 5 hours. Because heat is generated by the reaction, the flask was cooled in an ice water bath, and the temperature of the reaction solution was kept at 45° C.

The obtained reaction solution was transferred to a 2 liter washing tank and washed with 200 ml of a 3% by weight aqueous solution of sodium hydroxide twice and then with 200 ml of distilled water three times. The solvent and light fractions were removed from the washed reaction solution under a vacuum by using a rotary evaporator to obtain 535.6 g of a crude product.

An autoclave containing a catalyst prepared in accordance with the same procedures as those conducted in Preparation Example of Catalyst 1 was opened. After the liquid part in the autoclave was removed by decantation, 400 g of the crude product obtained above was added to the autoclave. After the autoclave was purged with nitrogen and then with hydrogen, the pressure of hydrogen was increased to 30 $kg/cm^2G$, and the temperature of the autoclave was increased. The temperature was kept at 140° C. for 2 hours, and then the autoclave was cooled to room temperature. The pressure in the autoclave was increased by the increase in the temperature, and decrease in the pressure of hydrogen was also observed because the reaction took place. When the pressure of hydrogen was decreased, hydrogen was suitably added, and the pressure in the autoclave was kept at 30 $kg/cm^2G$.

After the autoclave was purged with nitrogen, the pressure was released. The reaction solution was recovered, and 100 g of isooctane was added to the recovered reaction solution. The catalyst was removed from the resultant reaction solution by filtration. The obtained filtrate was treated by a rotary evaporator to remove the solvent and light fractions. The yield was 358 g.

The results of the NMR analysis and the IR analysis showed that one of the end structures of the obtained polymer was (A) or (D), and the other end structure was mainly (B) or (E) and contained 5% by weight or less of structure (C).

Preparation Example 6

Into a 1 liter glass separable flask, 125 g of isooctane, 60.65 g ($8.18\times10^{-1}$ mol) of isobutanol, and 0.322 g of boron trifluoride etherate were charged. Then, a mixture of 370.66 g (5.140 mol) of ethyl vinyl ether and 138.70 g (1.385 mol) of isobutyl vinyl ether was added to the obtained mixture during 5 hours. Because heat is generated by the reaction, the flask was cooled in an ice water bath, and the temperature of the reaction solution was kept at 45° C.

The obtained reaction solution was transferred to a 2 liter washing tank and washed with 200 ml of a 3% by weight aqueous solution of sodium hydroxide twice and then with 200 ml of distilled water three times. The solvent and light fractions were removed from the washed reaction solution under a vacuum by using a rotary evaporator to obtain 528.4 g of a crude product.

An autoclave containing a catalyst prepared in accordance with the same procedures as those conducted in Preparation Example of Catalyst 1 was opened. After the liquid part in the autoclave was removed by decantation, 400 g of the crude product obtained above was added to the autoclave. After the autoclave was purged with nitrogen and then with hydrogen, the pressure of hydrogen was increased to 30 $kg/cm^2G$, and the temperature of the autoclave was increased. The temperature was kept at 140° C. for 2 hours, and then the autoclave was cooled to room temperature. The pressure in the autoclave was increased by the increase in the temperature, and decrease in the pressure of hydrogen was also observed because the reaction took place. When the pressure of hydrogen was decreased, hydrogen was suitably added, and the pressure in the autoclave was kept at 30 $kg/cm^2G$.

After the autoclave was purged with nitrogen, the pressure was released. The reaction solution was recovered, and 100 g of isooctane was added to the recovered reaction solution. The catalyst was removed from the resultant reaction solution by filtration. The obtained filtrate was treated by a rotary evaporator to remove the solvent and light fractions. The yield was 358 g.

The results of the NMR analysis and the IR analysis showed that one of the end structures of the obtained polymer was (A) or (D), and the other end structure was mainly (B) or (E) and contained 5% by weight or less of structure (C).

Preparation Example 7

Into a 1 liter glass separable flask, 125 g of isooctane, 35.64 g ($7.74\times10^{-1}$ mol) of ethanol, and 0.305 g of boron trifluoride etherate were charged. Then, 534.36 g (7.410 mol) of ethyl vinyl ether was added to the obtained mixture during 5 hours. Because heat is generated by the reaction, the flask was cooled in an ice water bath, and the temperature of the reaction solution was kept at 45° C.

The obtained reaction solution was transferred to a 2 liter washing tank and washed with 200 ml of a 3% by weight aqueous solution of sodium hydroxide twice and then with 200 ml of distilled water three times. The solvent and light fractions were removed from the washed reaction solution under a vacuum by using a rotary evaporator to obtain 533.0 g of a crude product.

An autoclave containing a catalyst prepared in accordance with the same procedures as those conducted in Preparation Example of Catalyst 1 was opened. After the liquid part in the autoclave was removed by decantation, 400 g of the crude product obtained above was added to the autoclave. After the autoclave was purged with nitrogen and then with hydrogen, the pressure of hydrogen was increased to 30 $kg/cm^2G$, and the temperature of the autoclave was increased. The temperature was kept at 140° C. for 2 hours, and then the autoclave was cooled to room temperature. The pressure in the autoclave was increased by the increase in the temperature, and decrease in the pressure of hydrogen was also observed because the reaction took place. When the pressure of hydrogen was decreased, hydrogen was suitably added, and the pressure in the autoclave was kept at 30 $kg/cm^2G$.

After the autoclave was purged with nitrogen, the pressure was decreased to atmospheric pressure. The reaction solution was recovered, and 100 g of isooctane was added to the recovered reaction solution. The catalyst was removed from the resultant reaction solution by filtration. The obtained filtrate was treated by a rotary evaporator to remove the solvent and light fractions. The yield was 359 g.

The results of the NMR analysis and the IR analysis showed that one of the end structures of the obtained polymer was (A), and the other end structure was mainly (B) and contained 5% by weight or less of structure (C).

Preparation Example 8

Into a 1 liter glass separable flask, 125 g of isooctane, 59.42 g ($8.02\times10^{-1}$ mol) of isobutanol, and 0.316 g of boron trifluoride etherate were charged. Then, a mixture of 438.58 g (6.082 mol) of ethyl vinyl ether and 71.99 g ($7.19\times10^{-1}$ mol) of isobutyl vinyl ether was added to the obtained mixture during 5 hours. Because heat is generated by the reaction, the flask was cooled in an ice water bath, and the temperature of the reaction solution was kept at 45° C.

The obtained reaction solution was transferred to a 2 liter washing tank and washed with 200 ml of a 3% by weight aqueous solution of sodium hydroxide twice and then with 200 ml of distilled water three times. The solvent and light fractions were removed from the washed reaction solution under a vacuum by using a rotary evaporator to obtain 534.1 g of a crude product.

An autoclave containing a catalyst prepared in accordance with the same procedures as those conducted in Preparation Example of Catalyst 1 was opened. After the liquid part in the autoclave was removed by decantation, 400 g of the crude product obtained above was added to the autoclave. After the autoclave was purged with nitrogen and then with hydrogen, the pressure of hydrogen was increased to 30 $kg/cm^2G$, and the temperature of the autoclave was increased. The temperature was kept at 140° C. for 2 hours, and then the autoclave was cooled to room temperature. The pressure in the autoclave was increased by the increase in the temperature, and decrease in the pressure of hydrogen was also observed because the reaction took place. When the pressure of hydrogen was decreased, hydrogen was suitably added, and the pressure in the autoclave was kept at 30 $kg/cm^2G$.

After the autoclave was purged with nitrogen, the pressure was decreased to atmospheric pressure. The reaction solution was recovered, and 100 g of isooctane was added to the recovered reaction solution. The catalyst was removed from the resultant reaction solution by filtration. The obtained filtrate was treated by a rotary evaporator to remove the solvent and light fractions. The yield was 359 g.

The results of the NMR analysis and the IR analysis showed that one of the end structures of the obtained polymer was (A) or (D), and the other end structure was mainly (B) or (E) and contained 5% by weight or less of structure (C).

Preparation Example 9

Into a 1 liter glass separable flask, 250 g of toluene, 31.15 g ($4.20\times10^{-1}$ mol) of isobutanol, and 0.497 g of boron trifluoride etherate were charged. Then, 500.0 g (4.992 mol) of isobutyl vinyl ether was added to the obtained mixture during 5 hours. Because heat is generated by the reaction, the flask was cooled in an ice water bath, and the temperature of the reaction solution was kept at 25° C.

The obtained reaction solution was transferred to a 2 liter washing tank and washed with 200 ml of a 3% by weight aqueous solution of sodium hydroxide twice and then with 200 ml of distilled water three times. The solvent and light fractions were removed from the washed reaction solution under a vacuum by using a rotary evaporator to obtain 504.6 g of a crude product.

An autoclave containing a catalyst prepared in accordance with the same procedures as those conducted in Preparation Example of Catalyst 1 was opened. After the liquid part in the autoclave was removed by decantation, 400 g of the crude product obtained above was added to the autoclave. After the autoclave was purged with nitrogen and then with hydrogen, the pressure of hydrogen was increased to 30 $kg/cm^2G$, and the temperature of the autoclave was increased. The temperature was kept at 140° C. for 2 hours, and then the autoclave was cooled to room temperature. The pressure in the autoclave was increased by the increase in the temperature, and decrease in the pressure of hydrogen was also observed because the reaction took place. When the pressure of hydrogen was decreased, hydrogen was suitably added, and the pressure in the autoclave was kept at 30 $kg/cm^2G$.

After the autoclave was purged with nitrogen, the pressure was decreased to atmospheric pressure. The reaction solution was recovered, and 100 g of isooctane was added to the recovered reaction solution. The catalyst was removed from the resultant reaction solution by filtration. The obtained filtrate was treated by a rotary evaporator to remove the solvent and light fractions. The yield was 360 g.

The results of the NMR analysis and the IR analysis showed that one of the end structures of the obtained polymer was (D), and the other end structure was mainly (E) and contained 6% by weight or less of structure (C).

Preparation Example 10

Into a 5 liter glass flask equipped with a Dean Stark tube, a cooler, a stirrer, and a thermometer, 1091 g of pentaerythritol and 3909 g of n-hexanoic acid were charged, and the temperature of the obtained solution was increased while the solution was stirred. When the temperature of the solution reached 200° C., the solution was kept at this temperature for 3 hours. Then, the temperature of the solution was increased to 220° C., and the solution was kept at this temperature for 10 hours. During this period, the reaction started, and water was formed. After the reaction was finished, the reaction solution was cooled to 150° C., and the major part of unreacted n-hexanoic acid was recovered under a reduced pressure. The remaining solution was transferred to a washing tank and dissolved into 2 liter of hexane. The obtained solution was washed with 1,500 ml of a 3% by weight aqueous solution of sodium hydroxide three times and then with 1,500 ml of water three times. To the washed solution, 800 g of an ion exchange resin was added, and the resultant mixture was stirred for 3 hours. After the ion exchange resin was removed by filtration, the solvent and light fractions were removed from the mixture under a vacuum by using a rotary evaporator. The yield of the obtained polyol ester lubricating oil was 3390 g.

EXAMPLE 1

The kinematic viscosity, the compatibility with a mixed hydrofluorocarbon refrigerant, the volume intrinsic resistance, and the stability against hydrolysis of the lubricating oil comprising polyvinyl ether compound of the present invention obtained in Preparation Example 1 were obtained. The results are shown in Table 1.

The results of the $^1$H-NMR analysis and the IR analysis showed that the polyvinyl ether compound contained the constituting unit having the following formula (a') as the major component:

(a')

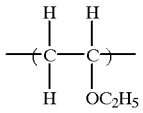

The kinematic viscosity, the compatibility with a mixed hydrofluorocarbon refrigerant, the volume intrinsic resistance, and the stability against hydrolysis were obtained in accordance with the following methods.

(1) Kinematic viscosity

The kinematic viscosity was obtained by using a glass capillary viscometer in accordance with the method of Japanese Industrial Standard K2283-1983.

(2) Compatibility test

A specified amount of a sample was placed in a pressure-resistant glass ampoule, and the ampoule was connected to a vacuum line and a line for a mixed hydrofluorocarbon refrigerant. The ampoule was degassed in a vacuum at room temperature, and a specified amount of the mixed hydrofluorocarbon refrigerant was taken into the ampoule in the liquid state. The ampoule was then sealed, and the temperature at which the phase separation starts was measured in a thermostat as follows: for the measurement of the compatibility at the low temperature side, the sample was slowly cooled from room temperature to −40° C., and for the measurement of the compatibility at the higher temperature side, the sample was slowly heated from room temperature to +400° C. A lower phase separation temperature is preferable in the lower temperature side, and a higher phase separation temperature is preferable in the higher temperature side.

(3) Volume intrinsic resistance

A sample was dried under a reduced pressure (0.3 to 0.8 mmHg) at 100° C. for 1 hour and then placed in a liquid cell for the measurement of the volume intrinsic resistance. The liquid cell was sealed and placed in a thermostat at 80° C. After the sample was kept in the thermostat at 80° C. for 40 minutes, the volume intrinsic resistance was measured at the impressed voltage of 250 V by using an ultrainsulation meter R8340 produced by ADVANTEST Company.

(4) Hydrolysis test

Into a 250 ml pressure-resistant glass bottle, 75 g of a sample, 25 g of water, and a piece of copper (13 mm×50 mm) were placed, and the atmosphere in the bottle was replaced with nitrogen. The sample was kept in a rotatory thermostat at a temperature of 102° C. for 192 hours. After finishing the test, the appearance of the sample and the condition of the copper piece were visually observed, and the total acid value was measured. The total acid values of sample oils before the test were 0.01 mgKOH/g for all the samples.

EXAMPLES 2 to 8

The kinematic viscosity, the compatibility with a mixed hydrofluorocarbon refrigerant, the volume intrinsic resistance, and the stability against hydrolysis of the lubricating oils comprising polyvinyl ether compounds of the present invention obtained in Preparation Examples 2 to 8 were obtained in accordance with the same methods as those used in Example 1. The results are shown in Table 1.

The results of the $^1$H-NMR analysis and the IR analysis showed that the polyvinyl ether compounds obtained in Preparation Examples 2 to 6 and 8 contained the constituting units having the following formulae (a') and (b') as the major components:

(a')

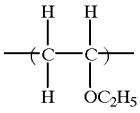

(b')

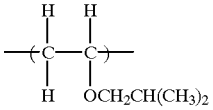

The ratio by mol of the constituting units having formulae (a') and (b') was obtained by the $^1$H-NMR analysis with the polyvinyl ether compounds. The results are shown in Table 1.

It was shown by the $^1$H-NMR analysis and the IR analysis that the polyvinyl ether compound obtained in Example 7 contained the constituting unit having formula (a') as the major component.

COMPARATIVE EXAMPLES 1 to 4

By using the polyvinyl ether compound obtained in Preparation Example 9 (Comparative Example 1), a commercial paraffinic mineral oil (Comparative Example 2), polyoxypropylene glycol (a product of NIPPON YUSHI Co., Ltd.; trade name, UNILUBE MB11) (Comparative Example 3), and the polyol ester obtained in Preparation Example 10 (Comparative Example 4), the kinematic viscosity, the volume intrinsic resistance, and the stability against hydrolysis were obtained in accordance with the same methods as those used in Example 1. The results are shown in Table 1.

The compatibility of the polyvinyl ether compound used in Comparative Example 1 and the commercial paraffinic mineral oil used in Comparative Example 2 with a mixed hydrofluorocarbon refrigerant was measured in accordance with the same method as that used in Example 1. The results are shown in Table 1.

It was shown by the $^1$H-NMR analysis and the IR analysis that the polyvinyl ether compound used in Comparative Example 1 contained the constituting unit having formula (b') as the major component.

TABLE 1-1

| | Sample | kinematic viscosity (cSt) 40° C. | 100° C. | ratio of constituting units (a')/(b') ratio by mol |
|---|---|---|---|---|
| Example 1 | Preparation Example 1 | 67.16 | 8.52 | (a') alone |
| Example 2 | Preparation Example 2 | 68.86 | 8.26 | 9/1 |
| Example 3 | Preparation Example 3 | 31.22 | 4.90 | 6/4 |
| Example 4 | Preparation Example 4 | 71.47 | 8.39 | 9/1 |
| Example 5 | Preparation Example 5 | 28.84 | 4.64 | 5/5 |
| Example 6 | Preparation Example 6 | 29.65 | 4.77 | 7/3 |
| Example 7 | Preparation Example 7 | 30.09 | 5.01 | (a') alone |
| Example 8 | Preparation Example 8 | 32.54 | 5.14 | 8/2 |
| Comparative Example 1 | Preparation Example 9 | 59.00 | 7.05 | (b') alone |
| Comparative Example 2 | *1 | 37.7 | 4.6 | — |
| Comparative Example 3 | *2 | 50.1 | 10.8 | — |
| Comparative Example 4 | Preparation Example 10 | 17.9 | 4.0 | — |

*1: A commercial paraffinic mineral oil

*2: Polyoxypropylene glycol (a product of NIPPON YUSHI Co., Ltd.; trade name, UNILUBE MB11)

TABLE 1-2

| | volume intrinsic resistance at 80° C. (Ω · cm) | after hydrolysis test sample oil appearance | total acid value (mgKOH/g) | appearance of copper |
|---|---|---|---|---|
| Example 1 | $1.7 \times 10^{13}$ | good | 0.5> | good |
| Example 2 | $2.1 \times 10^{13}$ | good | 0.5> | good |
| Example 3 | $4.5 \times 10^{13}$ | good | 0.5> | good |
| Example 4 | $1.0 \times 10^{13}$ | good | 0.5> | good |
| Example 5 | $2.0 \times 10^{13}$ | good | 0.5> | good |
| Example 6 | $2.4 \times 10^{13}$ | good | 0.5> | good |
| Example 7 | $1.1 \times 10^{13}$ | good | 0.5> | good |
| Example 8 | $1.0 \times 10^{13}$ | good | 0.5> | good |
| Comparative Example 1 | $1.4 \times 10^{14}$ | good | 0.5> | good |
| Comparative Example 2 | $2.0 \times 10^{14}$ | good | 0.5> | good |
| Comparative Example 3 | $5.8 \times 10^{8}$ | good | 0.5> | good |
| Comparative Example 4 | $4.0 \times 10^{12}$ | poor | 2.5 | poor |

TABLE 1-3

| | compatibility with R404A oil/(oil + refrigerant) (% by wt.) | temperature of phase separation at low temp. side (° C.) | temperature of phase separation at high temp. side (° C.) |
|---|---|---|---|
| Example 1 | 11.0 | −40> | 40< |
| | 15.0 | −40> | 40< |
| | 22.0 | −40> | 40< |
| Example 3 | 5.1 | −40> | 40< |
| | 15.0 | −40> | 37 |
| | 24.0 | −40> | 40< |
| Example 6 | 6.8 | −40> | 40< |
| | 16.0 | −40> | 40< |
| | 19.0 | −40> | 40< |

TABLE 1-3-continued

| | compatibility with R404A oil/(oil + refrigerant) (% by wt.) | temperature of phase separation at low temp. side (° C.) | temperature of phase separation at high temp. side (° C.) |
|---|---|---|---|
| Example 8 | 9.6 | −40> | 40< |
| | 14.3 | −40> | 40< |
| | 18.9 | −40> | 40< |
| Comparative Example 1 | 9.8 | phase separation | phase separation |
| | 15.3 | | |
| | 19.6 | | |
| Comparative Example 2 | 9.7 | phase separation | phase separation |
| | 14.6 | | |
| | 20.0 | | |

TABLE 1-4

| | compatibility with R410A oil/(oil + refrigerant) (% by wt.) | temperature of phase separation at low temp. side (° C.) | temperature of phase separation at high temp. side (° C.) |
|---|---|---|---|
| Example 4 | 9.4 | −40> | 40< |
| | 15.0 | −40> | 40< |
| | 19.8 | −40> | 40< |
| Example 6 | 4.7 | −37 | 40< |
| | 14.0 | −19 | 40< |
| | 21.0 | −22 | 40< |
| Example 7 | 4.9 | −40> | 40< |
| | 14.0 | −40> | 40< |
| | 19.0 | −40> | 40< |
| Example 8 | 4.7 | −40> | 40< |
| | 15.0 | −40> | 40< |
| | 20.0 | −40> | 40< |
| Comparative Example 1 | 10.6 | phase separation | phase separation |
| | 15.0 | | |
| | 20.3 | | |
| Comparative Example 2 | 10.1 | phase separation | phase separation |
| | 14.9 | | |
| | 20.5 | | |

TABLE 1-5

| | compatibility with R410B oil/(oil + refrigerant) (% by wt.) | temperature of phase separation at low temp. side (° C.) | temperature of phase separation at high temp. side (° C.) |
|---|---|---|---|
| Example 1 | 11.0 | −40> | 40< |
| | 16.0 | −40> | 40< |
| | 23.0 | −40> | 40< |
| Example 2 | 9.7 | −40> | 40< |
| | 15.0 | −40> | 40< |
| | 17.0 | −40> | 40< |
| Comparative Example 1 | 9.5 | phase separation | phase separation |
| | 14.6 | | |
| | 19.9 | | |
| Comparative Example 2 | 10.0 | phase separation | phase separation |
| | 15.3 | | |
| | 19.1 | | |

TABLE 1-6

| | compatibility with R507 | | |
|---|---|---|---|
| | oil/(oil + refrigerant) (% by wt.) | temperature of phase separation at low temp. side (° C.) | temperature of phase separation at high temp. side (° C.) |
| Example 1 | 9.4 | −40> | 40< |
| | 16.0 | −40> | 40< |
| | 20.0 | −40> | 40< |
| Example 5 | 9.3 | −40> | 38 |
| | 15.0 | −40> | 37 |
| | 20.0 | −40> | 39 |
| Example 6 | 9.5 | −40> | 40< |
| | 15.1 | −40> | 40< |
| | 20.1 | −40> | 40< |
| Example 8 | 9.3 | −40> | 40< |
| | 14.8 | −40> | 40< |
| | 19.7 | −40> | 40< |
| Comparative Example 1 | 9.9 | phase separation | phase separation |
| | 15.8 | | |
| | 20.7 | | |
| Comparative Example 2 | 10.4 | phase separation | phase separation |
| | 15.7 | | |
| | 20.1 | | |

What is claimed is:

1. A lubricating oil for compression-type refrigerators comprising (1) a mixed hydrofluorocarbon refrigerant consisting of 20 to 80% by weight of pentafluoroethane and 80 to 20% by weight of at least one refrigerant selected from the group consisting of difluoromethane, 1,1,1-trifluoroethane and 1,1,1,2-tetrafluoroethane and (2) a polyvinyl ether compound having (a) a constituting unit represented by the following general formula (I):

(I)

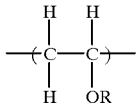

wherein R represents a hydrocarbon group which has 1 to 3 carbon atoms and may have ether bond in the group, or a polyvinyl ether compound having constituting unit (a) and (b) a constituting unit represented by the following general formula (I'):

(I')

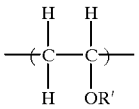

wherein R' represents a hydrocarbon group which has 3 to 20 carbon atoms, may have ether bond in the group, and is different from the hydrocarbon group represented by R in general formula (I), as the main component of the lubricating oil, wherein the ratio in mol of constituting unit (a) and constituting unit (b) in the polyvinyl ether compound is in the range of 10:0 to 5:5.

2. A lubricating oil according to claim 1 wherein the hydrofluorocarbon refrigerant containing pentafluoroethane is a mixed refrigerant containing 40 to 70% by weight of pentafluoroethane.

3. A lubricating oil according to claim 1 wherein the hydrofluorocarbon refrigerant containing pentafluoroethane is a mixed refrigerant consisting of difluoromethane and pentafluoroethane in a ratio by weight of 50:50, a mixed refrigerant consisting of difluoromethane and pentafluoroethane in a ratio by weight of 45:55, a mixed refrigerant consisting of pentafluoroethane, 1,1,1-trifluoroethane, and 1,1,1,2-tetrafluoroethane in a ratio by weight of 44:52:4, a mixed refrigerant consisting of pentafluoroethane and 1,1,1-trifluoroethane in a ratio by weight of 50:50, or a mixed refrigerant consisting of pentafluoroethane difluoromethane and 1,1,1,2-tetrafluoroethane in a ratio by weight of 25:23:52.

4. A lubricating oil according to claim 1 wherein the lubricating oil comprises a polyvinyl ether compound having (a') a constituting unit having general formula (I) in which R represents ethyl group or a polyvinyl ether compound having constituting unit (a') and (b') a constituting unit having general formula (I') in which R' represents isobutyl group.

5. A lubricating oil according to claim 1 wherein the ratio in mol of constituting unit (a) and constituting unit (b) in the polyvinyl ether compound is in the range of 10:0 to 7:3.

6. A lubricating oil according to claim 5 wherein the ratio in mol of constituting unit (a) and constituting unit (b) in the polyvinyl ether compound is in the range of 10:0 to 8:2.

7. A lubricating oil according to claim 1 wherein one end of the polyvinyl ether compounds has a structure represented by the following general formula (II):

II

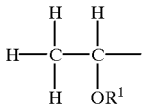

(wherein $R^1$ represents a hydrocarbon group which has 1 to 20 carbon atoms and may have ether bond in the group), and the other end of the polyvinyl ether compounds has a structure represented by the following general formula (III):

III

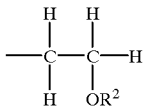

(wherein $R^2$ represents a hydrocarbon group which has 1 to 20 carbon atoms and may have an ether group in the group).

8. A lubricating oil according to claim 1 wherein one end of the polyvinyl ether compounds has a structure represented by general formula (II)

(II)

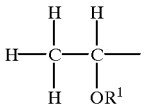

wherein $R^1$ represents a hydrocarbon group which has 1 to 20 carbon atoms and may have ether bond in the group, and the other end of the polyvinyl ether compounds has a structure having the following general formula (IV):

(IV)

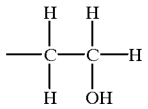

or structures represented by general formulae (III) and (IV), wherein general formula (III) has the following structure;

(III)

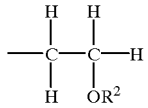

wherein $R^2$ represents a hydrocarbon group which has 1 to 20 carbon atoms and may have an ether group in the group.

9. An apparatus for refrigeration having a refrigeration cycle comprising at least a compressor, a condenser, an expansion mechanism and an evaporator which apparatus contains, as the main component of the lubricating oil for the apparatus, a polyvinyl ether compound having a constitution unit (a) represented by the general formula (I)

(I)

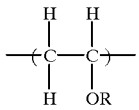

wherein R represents a hydrocarbon group which has 1 to 3 carbon atoms and may have ether bond in the group or a polyvinyl ether compound having both a constitution unit (a) and a constituting unit (b) represented by the general formula (I')

(I')

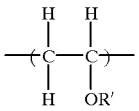

wherein R' represents a hydrocarbon group which has 3 to 20 carbon atoms, may have ether bond in the group, and is different from the hydrocarbon group represented by R in general formula (I), which apparatus contains, as a refrigerant, a mixed hydrofluorocarbon consisting of 20 to 80% by weight of pentafluoroethane and 80 to 20% by weight of at least one refrigerant selected from the group consisting of difluoromethane, 1,1,1-triflouoroetane and 1,1,1,2-tetrafluoroethane.

10. A lubricating oil composition according to claim 1 wherein the hydrofluorocarbon refrigerant containing pentafluoroethane is a mixed refrigerant consisting of difluoromethane and pentafluoroethane, a mixed refrigerant consisting of pentafluoroethane, 1,1,1-trifluoroethane, and 1,1,1,2-tetrafluoroethane, a mixed refrigerant consisting of pentafluoroethane and 1,1,1-trifluoroethane, or a mixed refrigerant consisting of pentafluoroethane, difluoromethane and 1,1,1,2-tetrafluoroethane.

11. A lubricating oil according to claim 1, wherein the mixed refrigerant is selected from the group consisting of R404A, R410A, R410B, and R507.

12. The apparatus according to claim 9, wherein the mixed refrigerant is selected from the group consisting of R404A, R410A, R410B, and R507.

* * * * *